US006244643B1

(12) United States Patent
Tillaart

(10) Patent No.: US 6,244,643 B1
(45) Date of Patent: Jun. 12, 2001

(54) VEHICLE-MOUNTED GRAPPLE DEVICE

(75) Inventor: Marlin Tillaart, Brougham (CA)

(73) Assignee: Dutchmaster Nurseries Ltd., Brougham (CA)

( * ) Notice: Subject to any disclaimer, the term of this patent is extended or adjusted under 35 U.S.C. 154(b) by 0 days.

(21) Appl. No.: 09/552,793

(22) Filed: Apr. 20, 2000

(51) Int. Cl.[7] ..... B66C 1/10
(52) U.S. Cl. ..... 294/86.41; 294/88; 901/29
(58) Field of Search ..... 294/86.41, 88, 294/104, 110.1; 414/729, 739, 742, 743, 704, 711, 725; 901/21, 29, 39

(56) References Cited

U.S. PATENT DOCUMENTS

| | | | | |
|---|---|---|---|---|
| 3,182,813 | * | 5/1965 | Goodell et al. | 901/29 |
| 3,371,952 | * | 3/1968 | Hunger | 294/88 |
| 3,460,329 | * | 8/1969 | Overstreet, Jr. | 294/88 |
| 3,902,614 | * | 9/1975 | Roberts et al. | 294/88 |
| 4,256,429 | * | 3/1981 | Dwyer | 294/86.41 |
| 4,273,506 | * | 6/1981 | Thomson et al. | 294/88 |
| 4,451,194 | * | 5/1984 | Keats et al. | 294/86.41 |
| 4,503,722 | * | 3/1985 | Suzuki et al. | 901/21 |
| 4,527,446 | * | 7/1985 | Borodin | 901/21 |
| 4,951,990 | * | 8/1990 | Hollan et al. | 294/86.41 |
| 5,073,080 | * | 12/1991 | Blum | 294/86.41 |
| 5,391,050 | * | 2/1995 | Gatteschi | 294/119.1 |
| 5,413,454 | * | 5/1995 | Movsesian | 901/39 |
| 5,516,174 | * | 5/1996 | Squyres | 294/86.41 |
| 5,584,646 | * | 12/1996 | Lewis et al. | 294/86.41 |
| 5,647,723 | * | 7/1997 | Rush | 901/29 |
| 5,711,565 | * | 1/1998 | Smith et al. | 294/88 |

FOREIGN PATENT DOCUMENTS

| | | | | |
|---|---|---|---|---|
| 952862 | * | 8/1974 | (CA) | 414/739 |

* cited by examiner

*Primary Examiner*—Dean J. Kramer
*Assistant Examiner*—Paul T. Chin
(74) *Attorney, Agent, or Firm*—Ridout & Maybee

(57) ABSTRACT

A material-handling device is disclosed, particularly for use as grappling apparatus for the loading and unloading of balled trees and shrubs in the nursery industry. By providing hydraulically powered rotational mechanism in the vertical plane coupled to and in front of hydraulically powered rotational mechanism in the horizontal plane, an arrangement is provided which is capable of rotating a load by a full 190° about a vertical axis and tilting the load vertically in a range of about 100°, while developing greater lifting power and economic advantages over similar apparatus employing pivot rotary actuators.

8 Claims, 3 Drawing Sheets

VEHICLE-MOUNTED GRAPPLE DEVICE

FIELD OF THE INVENTION

The present invention relates to a grapple device which may be attached to the lifting arms of a loading vehicle.

More particularly, the invention relates to an improved "tree picker" apparatus for use primarily in the nursery industry in the movement and loading of the trees.

BACKGROUND OF THE INVENTION

Various kinds of grappling apparatus have been used in the plant nursery industry to lift and move balled trees and shrubs. All are characterized by some form of arrangement of movable jaws for gripping bagged root ball of a tree and powered means for lifting the tree and moving a rotating clamped jaw in various angular and linear degrees of freedom.

Unfortunately, many of these kinds of apparatus suffer from the practical shortcomings of limiting the operator visibility during use, by reason of a complete lack or insufficiency of ability to rotate the clamping arrangement in the vertical plane so as to raise the plant (or other load) out of the operator's line of sight.

A number of known devices exhibit a fair degree of maneuverability of the clamped article, but employ undependable or costly articulation means, such as pivot rotary actuators for moving the clamped tree about. The present arrangement also develops greater power and is easier to repair than prior such devices to a virtual height where the vehicle operator has a clear view of the load being carried and can satisfy himself that the lad is properly gripped by the clamping means.

SUMMARY OF THE INVENTION

It is an object of the present invention to provide a grapple device which is durable, economical and adapted for use within any conventional truck, tractor, loader or vehicle of the kind used in tree transplanting operations.

It is a further object of the invention to provide a grapple device of this kind, which, by the use of interchangeable gripping blades or paddles can be adapted for use in moving rocks, skids, logs and other loads.

I have found that by an arrangement in which the vertical pivoting mechanism is forwardly displaced (relative to the operator) from the horizontal-plane pivoting arrangement of the grapple device the aforementioned mentioned desirable ability to rotate the clamping arrangement in the vertical plane so as to raise the load sufficiently to be clearly viewed by the operator may be achieved.

The material-handling device disclosed and claimed herein is capable of rotating the load by a full 190° about a vertical axis and of tilting vertically in a range of a full 100°, thereby affording the vehicle operator a far better opportunity than hitherto available to carry out the grappling operation with a clear view of the load being moved and of its immediate surroundings.

The present invention provides a grapple device for attachment of the lifting arms of the loading vehicle in which a linearly extended rear frame section of the device is mounted to the lifting arms of the vehicle, an intermediate frame section is pivotably mounted to the rear frame section for rotational motion in the horizontal plane (when the lifting arms of the vehicle are horizontally disposed).

A transversely extending front frame section pivotably mounted to the intermediate frame section for rotational motion in the vertical plane, about an axis appreciably forwardly displaced from the first rotational axis. The front frame section carries the gripping paddles, which are opened and closed by hydraulic cylinder actuators and there is a bumper plate to assist in the gripping operation. The bumper plate is positioned between the paddle arms and connected by a toggle linkage to the interior of the arms so that the plate extends as grapple paddles or blades close together and retracts as they open up, to release the load.

Preferably, angular motion in the horizontal and the vertical plane are separately driven by conventional piston-and-cylinder hydraulic actuators.

A preferred embodiment of the invention will now be illustrated by means of the drawings and detailed description below.

DETAILED DESCRIPTION OF THE PREFERRED EMBODIMENT

The device comprises a rear frame section 10 of durable construction which includes a rearmost portion 12 that may be attached by any conventional means to the front of a loading vehicle. Along the length of the rear frame section 10 and preferably housed within a hollow cavity thereof is an actuating mechanism comprising a pair of hydraulic cylinders 14*a* and 14*b* respectively, connected by their moving piston portions 15*a* and 15*b* to a pair of chain segments or other tensile members 16*a* and 16*b*, working cooperatively to turn a coupling member, e.g. split sprocket 18 rotatably mounted at the front of rear frame section 10. The periphery of sprocket 18 presents one or more studs or projecting element (not shown) for securing chain segments.

Figure 2:
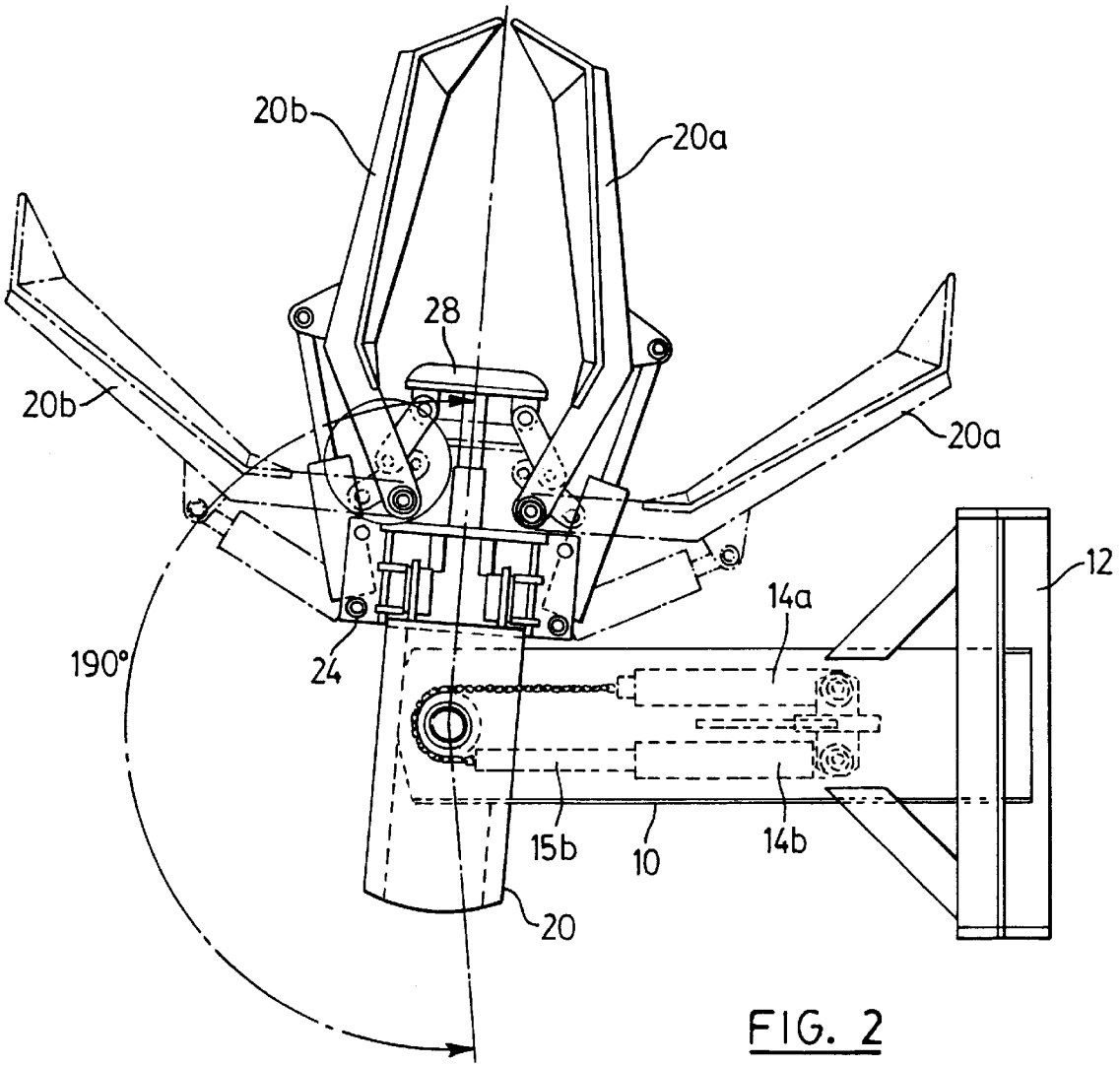
FIG. 2 is a top plan view of the device having the grappling mechanism rotated to one side and showing in dotted outline the grapple paddles opened to their full extent.
Figure 3:
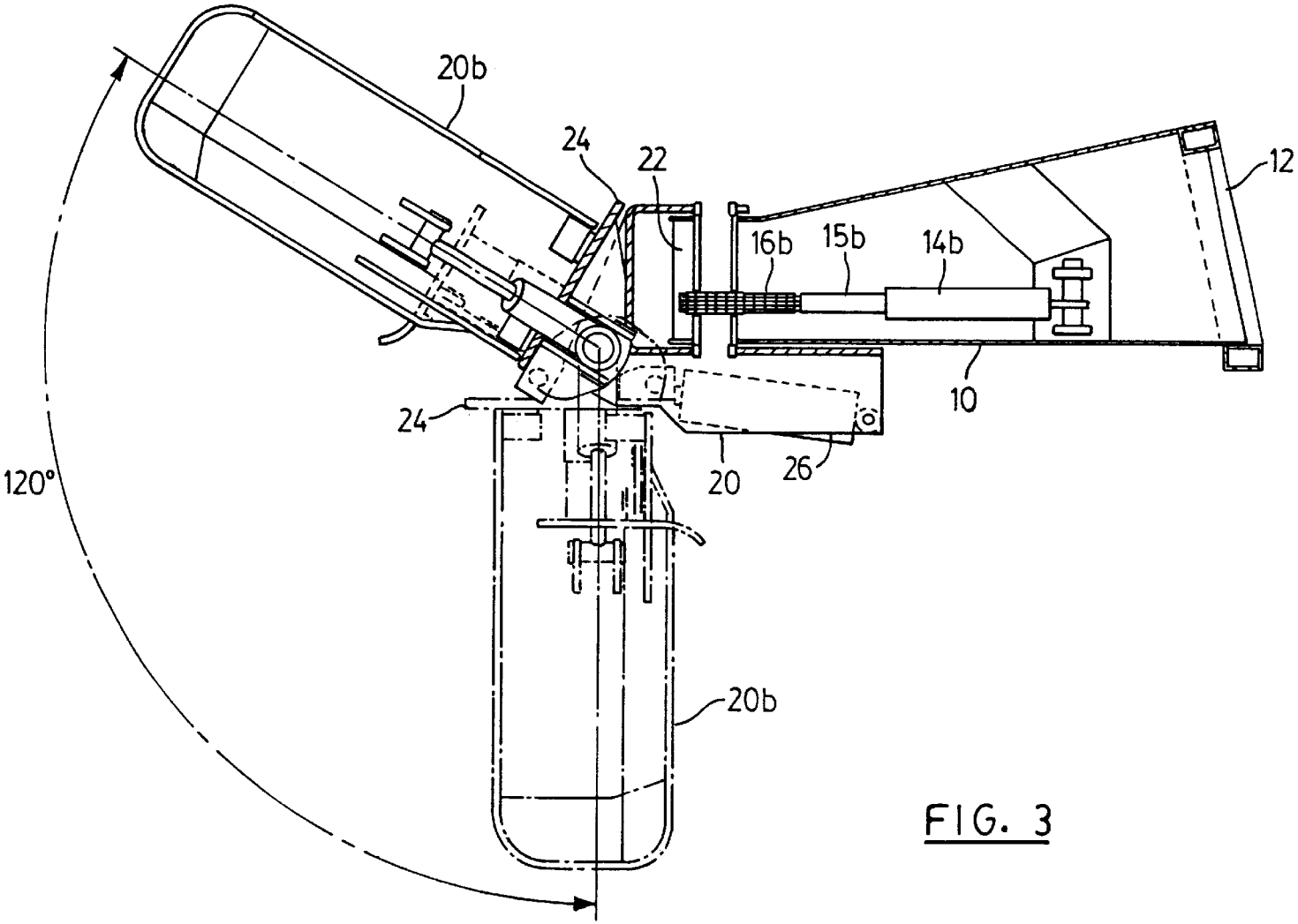
FIG. 3 is a side elevational view of the device illustrating rotation in the vertical plane.

Rotatable sprocket 18 is connected to an intermediate frame section 20 for swivelling action thereof in the horizontal plane by up to 190°, as best seen in FIG. 2. The operative connection between the rear frame section and the intermediate frame section may be the provision of a vertical mounting bar 22 on the intermediate frame section which fits closely within a keyway through split sprocket 18 to link the intermediate and rear frame sections together.

Figure 1A:
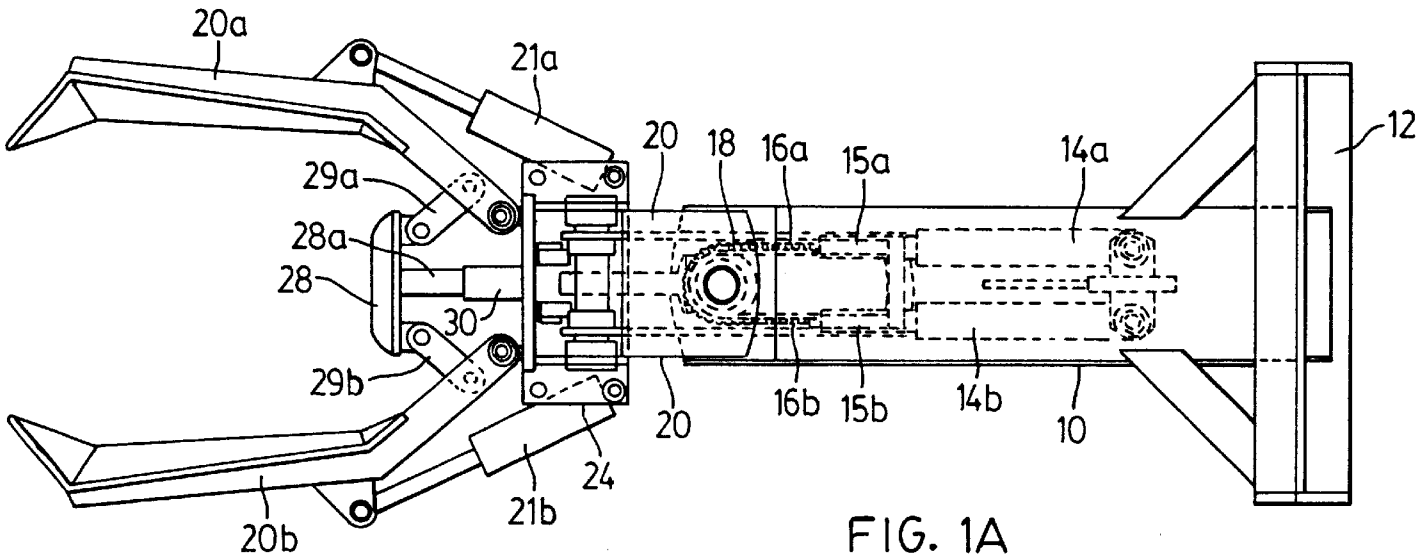
FIGS. 1A and 1B are, respectively, top and side elevational plan views of a device according to the invention.
Figure 1B:
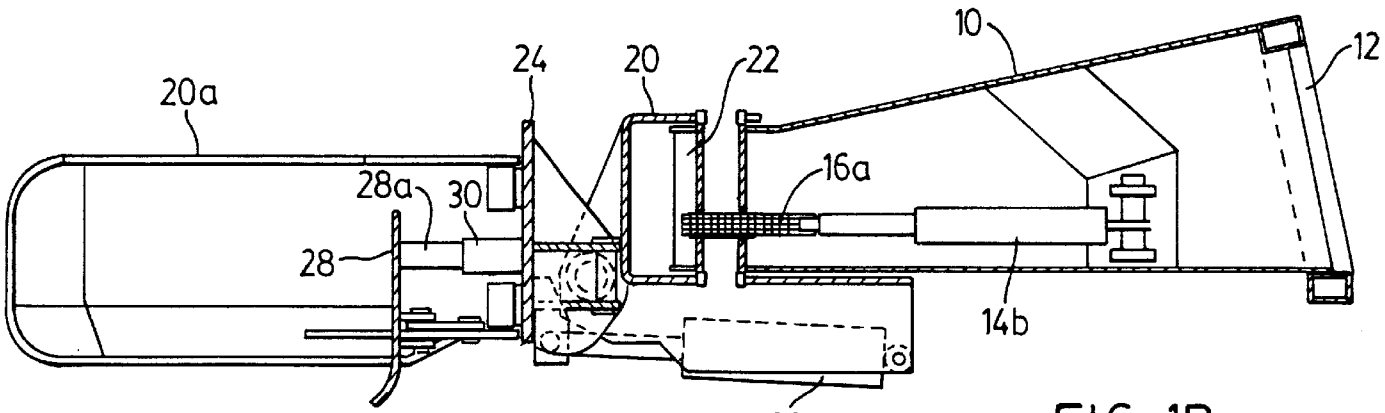

The front portion of intermediate frame section 20 is pivotally connected to a frontmost frame section 24 including gripping paddle arms 20*a* and 20*b* powered to open and close by conventional motor and hydraulic piston means. As best seen in FIG. 1*a*, pistons 21*a* and 21*b* respectively actuate blades or paddles 20*a* and 20*b*.

The connection between the front portion of intermediate frame section 20 and the rear portion of the front gripping frame section 24 includes pivoting means to allow the front section to swivel in the vertical plane through a full-angular range of about 100° C., which rotation movement is preferably powered by hydraulic cylinder actuating means 26, which operatively connects the intermediate to the front frame section.

By this arrangement, the gripping paddles 20*a* and 20*b* compressing the load can be titled to an angle which allows for a view of the load to be moved, but is highly enhanced as compared to similar existing equipment.

In the preferred embodiment, an extendible shoe or bumper plate 28 is connected by articulating arms 29*a* and 29*b* of a toggle linkage to gripping paddles 20*a* and 20*b*, so that closing of the paddles moves bumper plate 28 formed toward the load (e.g. plant root ball) and opening the paddles moves bumper plate 28 rearwardly away from the load.

Linear motion of bumper plate 28 in use is controlled by the channelled sliding of an integral slider rod or tube 28*a* within a hollow guide channel tube 30 mounted centrally to the front of the front frame section 24.

The arrangement with an automatically extending bumper plate is particularly effective in the secure gripping of more or less spherical objects such as rocks and tree balls, and cylindrical objects such as logs.

In its broadest concept, the invention may be used not only in its presently preferred application for lifting and moving trees for transplantation, but in any material handling system or apparatus. It will be obvious to those skilled in the art that the present invention is not limited to the specific embodiment described and illustrated but is susceptible to various changes and modifications without departing from the spirit and scope of the invention.

I claim:

1. A grapple device for attachment to the lifting arms of a loading vehicle comprising:

a linearly extending rear frame section including means at one end thereof for mounting the device to the lifting arms of the vehicle;

an intermediate frame section pivotably mounted to said rear frame section for rotational movement relative thereto about a first axis in a first plane parallel to the lengthwise axis of said rear frame sections and means for actuating and controlling said rotational motion of the intermediate frame section;

a transversely extending front frame section pivotably mounted to said intermediate frame section for motion about a second axis, forwardly displaced from said first axis, in a second plane perpendicular to said first plane, and means for actuating and controlling said rotational motion of the front frame section; and gripping means associated with said front frame section, comprising a pair of transversely spaced gripping paddle arms extending forwardly from said front frame section, hydraulic cylinder actuators connected between said front frame section and respective outer surfaces of said paddle arms, a bumper plate positioned between the gripping paddle arms and a toggle linkage connecting rear pivot connections on said bumper plate to corresponding pivot connections on said gripping paddle arms, such that hydraulically actuated closing of the paddle arms causes forward linear movement of said bumper plate to engage a load gripped by the paddle blades.

2. A grapple device according to claim 1, wherein said means for actuating and controlling said rotational motion of the intermediate frame section relative to the rear frame section and said rotational motion of the front frame section relative to the intermediate frame section are hydraulically driven.

3. A grapple device according to claim 2, wherein said means for actuating and controlling said rotational motion of the front frame section comprises a powered hydraulic cylinder and piston pivotably mounted at opposite ends thereof to respective connections on the front and intermediate frame sections.

4. A grapple device according to claim 3, wherein said means for actuating and controlling said rotational motion of the intermediate frame section comprises a longitudinal pair of powered hydraulic cylinders symmetrically mounted along said linearly extending rear frame section, a coupling member mounted to a fixed axle on said rear frame section for rotation within said first plane, and two tensile members respectively connected at one end thereof to the pistons of said hydraulic cylinders for rotation of said coupling member by cooperative action of the hydraulic cylinders, and means for connecting said intermediate section to said gear wheel.

5. A grapple device according to claim 4, wherein said coupling comprises a split sprocket axially mounted to said fixed axle and said tensile members are chain segments connected to at least one projecting element on the periphery of said sprocket.

6. A grapple device according to claim 5, wherein said means for connecting said intermediate frame section to said sprocket comprises a keyway through the sprocket and a crossbar integral with said intermediate section, closely fitted with end said keyway thereby operatively connecting the intermediate section with the rotating sprocket.

7. A grapple device according to claim 6, wherein said rear frame section is in the form of a hollow housing surrounding and shielding said longitudinal pair of powered hydraulic cylinders.

8. A grapple device according to claim 2, further comprising a slider tube integral with said bumper plate and extending rearwardly therefrom and accommodating guide channel member therefor mounted to said front frame section.

* * * * *